US005163668A

United States Patent [19]

Winship et al.

[11] Patent Number: 5,163,668

[45] Date of Patent: Nov. 17, 1992

[54] RETARD PAD ASSEMBLY WITH MOVABLE COMPLIANT ENTRANCE GUIDE

[75] Inventors: Bruce A Winship; Donald E. Johnston, both of Rochester; Richard C. Benton, Ontario, all of N.Y.

[73] Assignee: Xerox Corporation, Stamford, Conn.

[21] Appl. No.: 751,895

[22] Filed: Aug. 29, 1991

[51] Int. Cl.[5] ..... B65H 3/52

[52] U.S. Cl. ..... 271/121; 271/124; 271/1

[58] Field of Search ..... 271/121, 123, 124, 125, 271/182, 900, 137, 138, 167

[56] References Cited

U.S. PATENT DOCUMENTS 3,768,803 10/1973 Stange ..... 271/121
4,660,963 4/1987 Stemmle .
4,815,724 3/1989 Sumida et al. ..... 271/121

FOREIGN PATENT DOCUMENTS 0212637 9/1988 Japan ..... 271/121
0081726 3/1989 Japan ..... 271/121
2178135 7/1990 Japan .

*Primary Examiner*—H. Grant Skaggs

[57] ABSTRACT

A retard assembly for use in a friction retard separator and feeder comprising a support member for supporting a retard member and a sheet entrance guide at the incoming end of the retard assembly having a substantially vertical portion and a substantially horizontal portion overlying the incoming guide entrance portion of the retard member in advance of the retard portion of the retard member, said sheet guide being vertically compliant and movable in said support member to enable a reduction in the spring rate in the entrance guide portion of the retard member to a level substantially below the level in the retard portion.

18 Claims, 5 Drawing Sheets

RETARD PAD ASSEMBLY WITH MOVABLE COMPLIANT ENTRANCE GUIDE

CROSS REFERENCE TO RELATED APPLICATION

Attention is directed to copending commonly assigned application Ser. No. 07/528,314, entitled Constant Coefficient Noiseless Friction Retard Member, filed May 24, 1990 in the name of LaFica et al.

BACKGROUND OF THE INVENTION

The present invention relates generally to sheet feeding and separating apparatus and more particularly to a retard member for use in a friction retard sheet separator feeder which has a stable coefficient of friction and provides quiet sheet separation for a variety of different weight sheets. It has a particular application in the feeding of sheets in electrostatographic printing machines such as, for example, those illustrated in U.S. Pat. No. 4,660,963 to Stemmle.

The development of electrostatographic printing machines has brought about the need for simple, yet reliable, sheet separator feeder apparatus capable of handling sheets varying in length, thickness, weight and surface conditions. One of the more common arrangements involves friction retard feeders wherein separation and feeding is dependent upon a differential friction principle. In one such type of feeder, a feed roller surface has a relatively high coefficient of friction with paper while the retarding surface which may also be a roller driven in the opposite direction or alternatively a stationary pad having a coefficient of friction with paper less than that of the feed roller, but greater than that between two successive sheets of paper. In these feeders, the coefficient of friction of the feed roller with the paper must exceed the coefficient of friction of the retard member which must always exceed that of the coefficient of friction between two sheets of paper. In these separator feeders the region of contact between the retarding member and the feed roll forms a sheet queuing throat which is able to fan out or que sheets in the throat for feeding single sheets through the throat.

FIG. 1 schematically illustrates a typical sheet separator feeder apparatus capable of handling sheets varying in length, thickness, weight, and surface conditions which includes a sheet support platform 10 urged upwardly by spring 11 to advance sheets to be separated and fed to the friction retard nip formed between the retard member 12 and feed roll 13. The feed roller surface has a relatively high coefficient friction with the paper while the retard member has a lower coefficient of friction with the paper but its coefficient of friction with the paper is greater than the coefficient of friction between two successive sheets. This relationship and geometry enables the shingling or staggering of individual sheets into the nip between the feed roll and retard pad to the path defined by the sheet guide 15. Typically the feed roll is made from a silicone rubber or other elastomer having a coefficient of friction greater than about 1.5. While capable of performing satisfactorily, there are problems associated with these types of feeders. One of the more common problems is feeding reliability, that is the feeding of single sheets only from the nip between the feed roller and the retard member rather than a multifeed of from two up to perhaps six sheets The multifeed difficulty can be further appreciated with reference to FIG. 6, wherein a friction retard sheet separator feeder is provided which has a rigid and fixed sheet entrance guide to guide sheets into the sheet retard nip area. The multi-sheet feed situation occurs in the entrance guide area A in advance of the retard nip area B by a slug, six or more sheets, entering the entrance guide area which become pinched between the entrance guide and the feed wheel. Because the entrance guide is rigid and fixed, an additional normal force N is created between the entrance guide and the feed wheel, which creates an increased driving force to drive the slug through the retard nip creating a situation that overpowers the retard systems ability to frictionally separate the slug. In addition, lead edge damage from sheet stubbing is caused by the relatively large distance between the end of entrance guide area A and the entrance to the retard nip area B.

PRIOR ART

U.S. Pat. No. 4,815,724 to Sumida et al. discloses a sheet feeding mechanism that will prevent sheet overlapping at a nip area. The mechanism is pivotally mounted on a fixture piece 26. A supporting member 30 is further mounted on a front end portion of a rocking arm 28 so that it is free to move towards and away from the peripheral surface of the roller 22. The friction member 24 is mounted on the surface of the supporting member 30. A spring member 32 for biasing the supporting member 30 towards the roller 22 is interposed between the front end of the rocking arm 28 and a lower end portion of the supporting member 30. A rocking member 34 is mounted on one end of a shaft member 16 and is connected to an output terminal of an actuating means 36 such as an electromagnetic solenoid. See FIGS. 1 and 2 of Sumida et al.

SUMMARY OF THE INVENTION

In accordance with a principle aspect of the present invention a retard assembly and a friction sheet separator feeder are provided, which provides greater reliability of sheet feeding and in particular, minimizes difficulties associated with multi-sheet or slug feeding.

In a further aspect of the present invention a retard assembly has a support member for supporting a retard member in a sheet entrance guide at the incoming end of the retard assembly which has a substantially vertical portion and a substantially horizontal portion overlying the incoming guide entrance portion of the retard member in advance of the retard portion of the the retard member. The sheet guide is vertically compliant and movable in the support member to enable a reduction in the spring rate in the entrance guide portion of the retard member to a level substantially below the level in the retard portion.

In a further aspect of the present invention, the retard member comprises a top friction retarding surface layer having a stable coefficient of friction and an intermediate absorption layer between the support member and the surface layer.

In a further aspect of the present invention, this sheet entrance guide has a surface having a low coefficient of friction with paper.

In a further aspect of the present invention, the substantially horizontal portion of this sheet entrance guide overlies a portion of the friction retarding surface layer of the retard member and there is a void between the substantially vertical portion of the sheet entrance guide and the vertical edges of the intermediate vibration absorption layer and the top friction retarding surface layer.

In a further aspect of the present invention the void between the vertical portion of the sheet guide and the edge of the intermediate vibration absorption layer is greater than the void between the vertical portion and the edge of the friction retarding surface layer.

In a further aspect of the present invention, mounting means such as intregally molded tabs are provided on the support member and mounting couplings having channels which engage the mounting tabs are provided on the sheet entrance guide.

In a further aspect of the present invention, the friction retarding surface layer is of an ethylene propylene diene rubber having a stable coefficient or friction of about 1.2 and the vibration absorption layer is a closed cell polychloroprene foam having a density of from about 12 to 22 pounds per cubic foot. For a better understanding as well as other objects and further features thereof, reference is made to the following drawings and description.

DESCRIPTION OF PREFERRED EMBODIMENT

Figure 1:
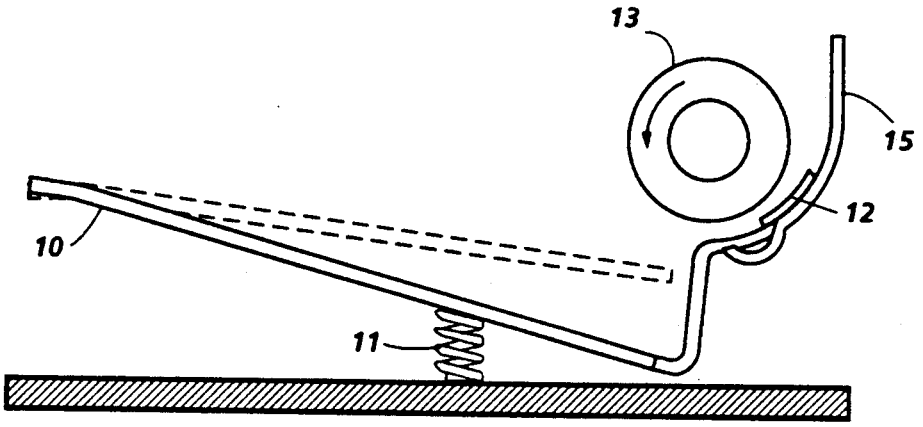
FIG. 1 is a schematic representation in cross section of a friction retard separator, and feeder according to the present invention.
Figure 3:
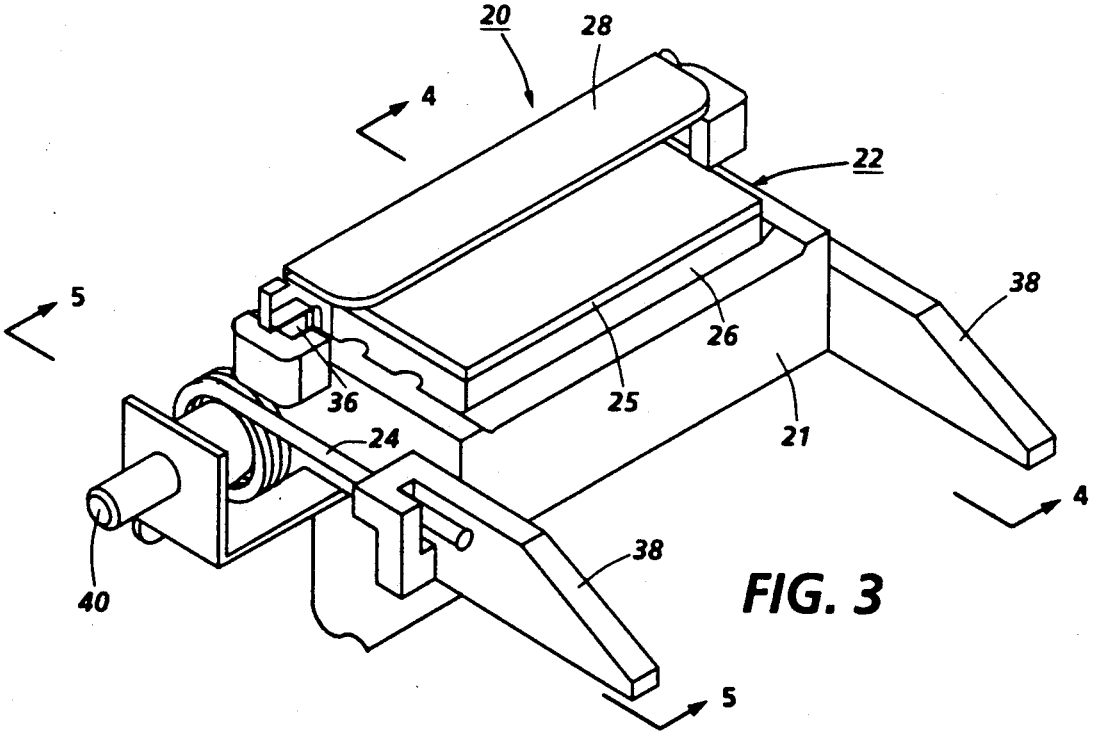
FIG. 3 is an isometric view of the retard assembly according to the present invention.
Figure 2:
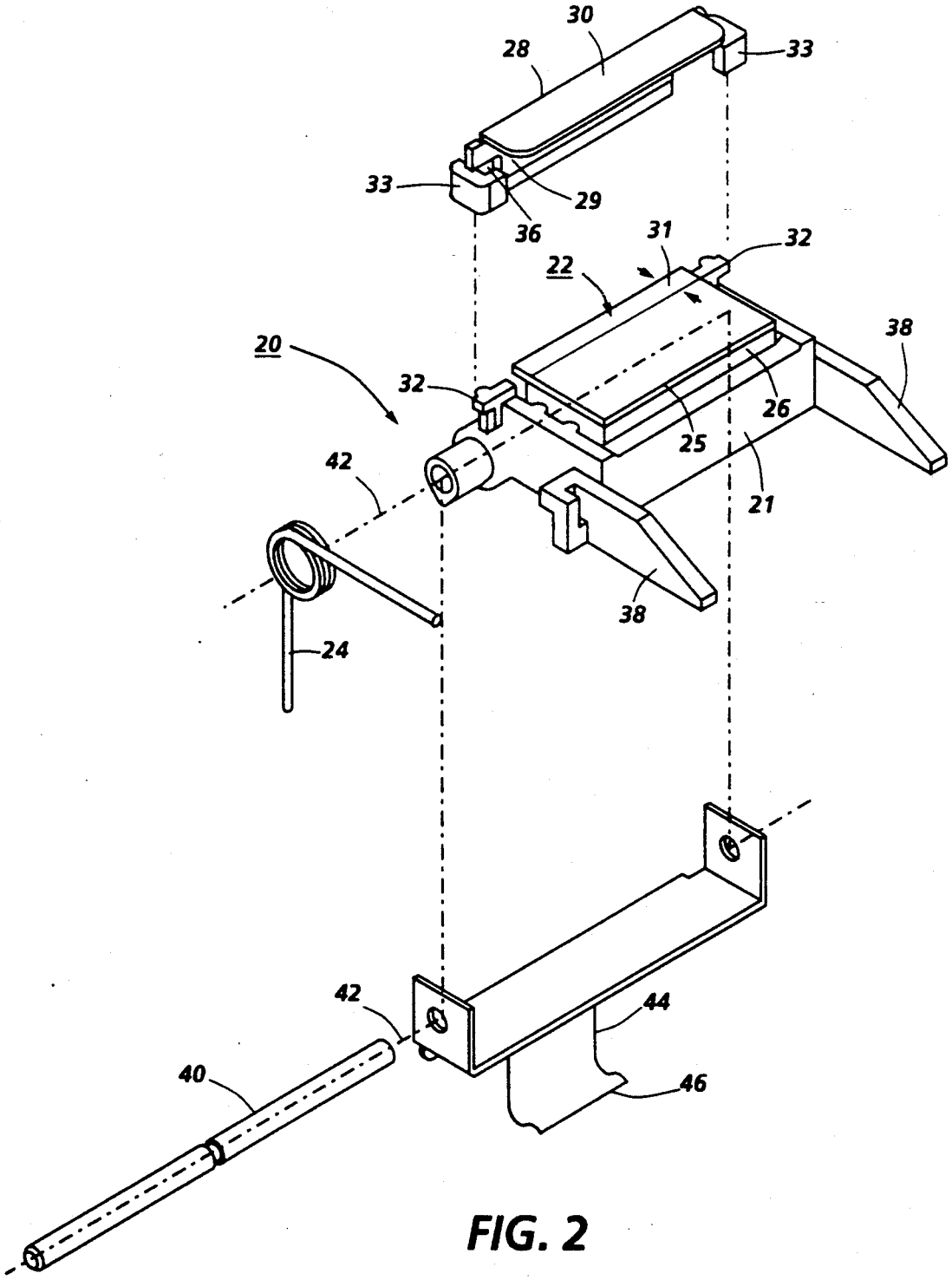
FIG. 2 is an exploded isometric view of the retard assembly according to the present invention.
Figure 4:
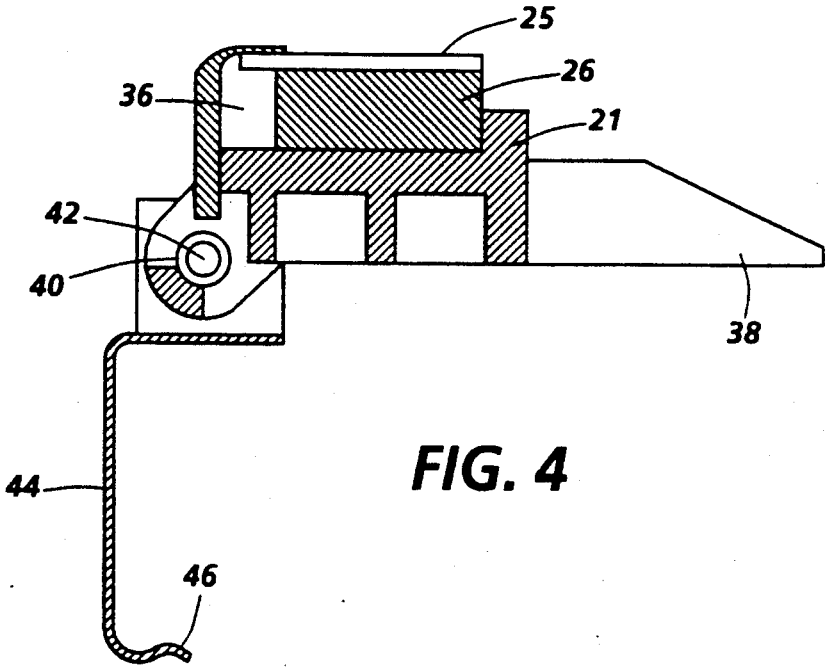
FIGS. 4 and 5 are sectional views taken along the lines 44 and 55 respectively in FIG. 3.
Figure 5:
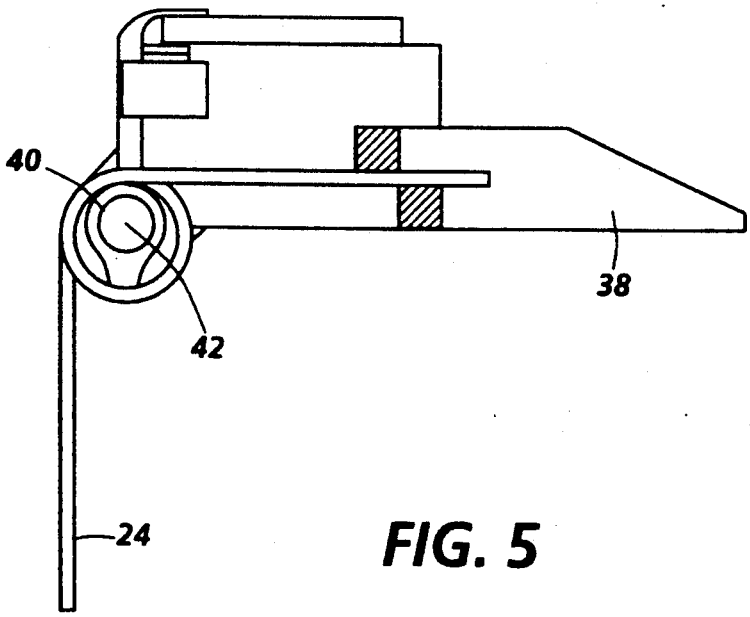
Figure 6:
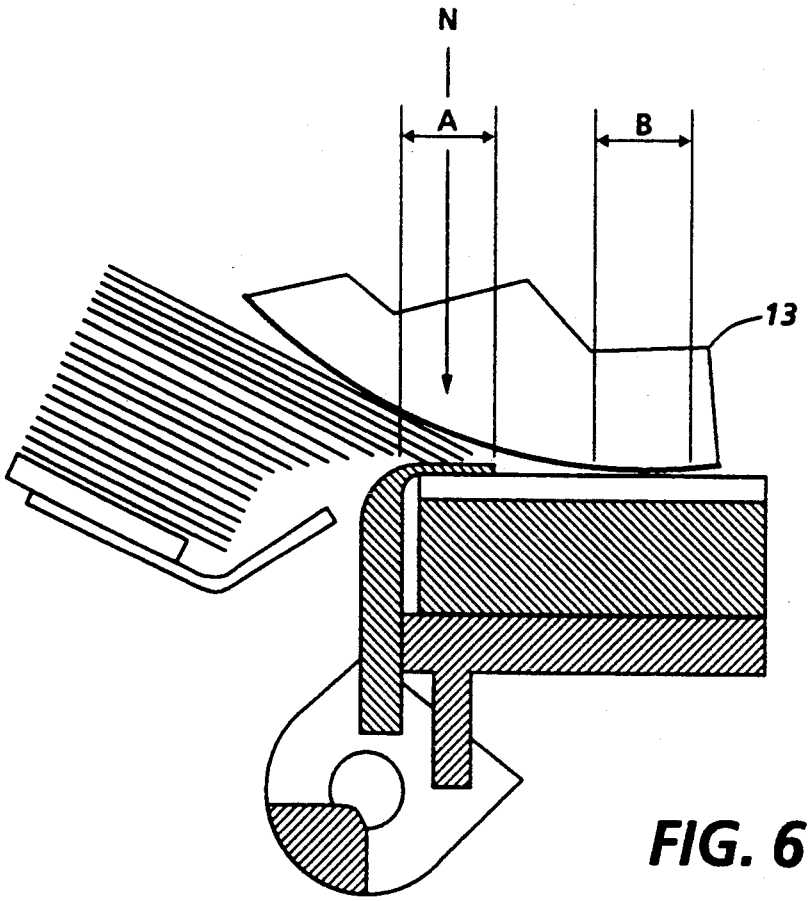
FIG. 6 is a schematic representation of a sheet separator feeder according to prior art practices.
Figure 7:
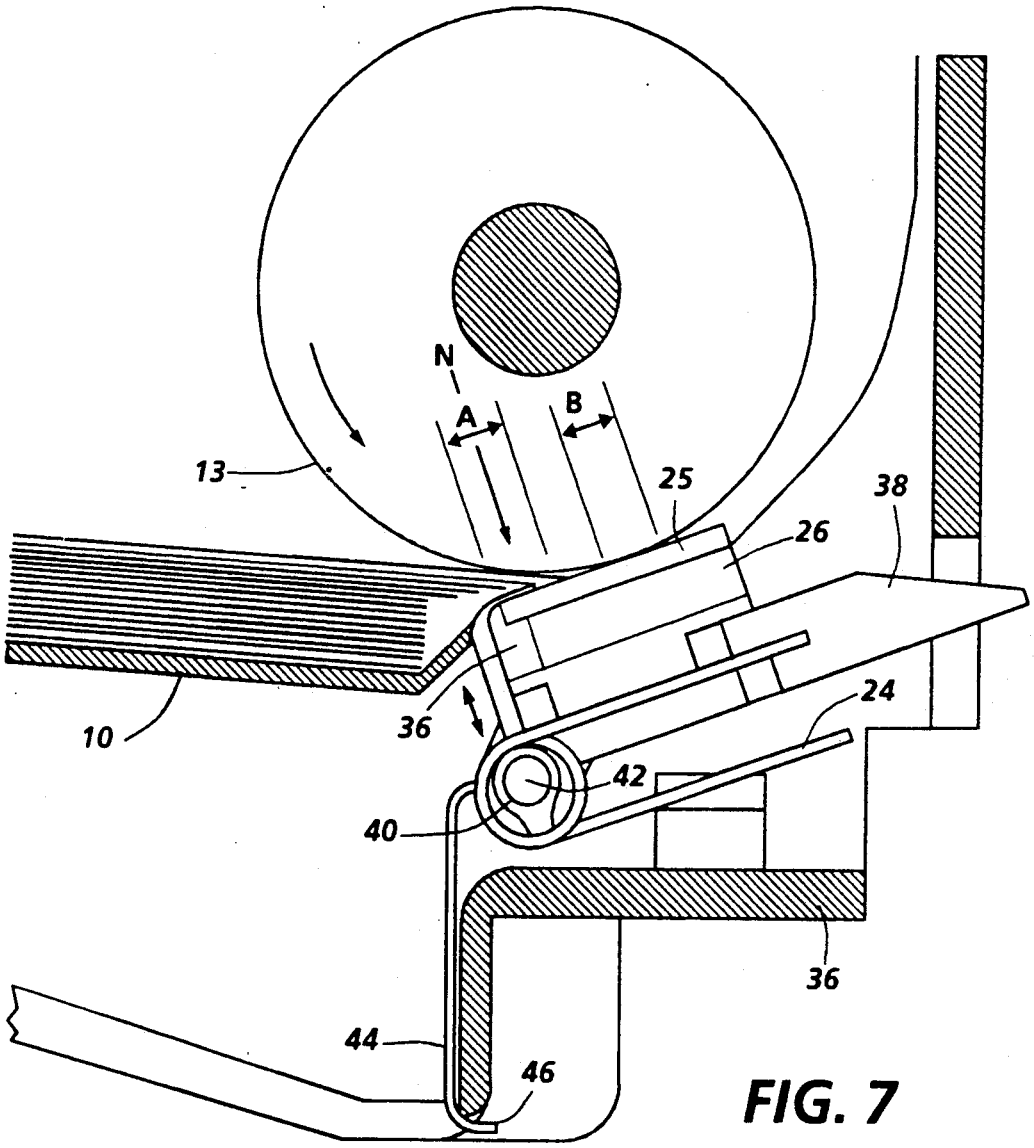
FIG. 7 is a similar schematic representation of the compliant movable sheet entrance guide employed in the practice of the present invention.

As seen with reference to FIGS. 2–5 and 7 the retard assembly 20 has an entrance guide area A and retard area B and comprises a support member 21 which supports a retard member 22 comprising a top friction retarding surface layer 25 having a stable coefficient of friction and an intermediate vibration absorption layer 26. The vibration absorption layer 26 may be secured to the support member 21 by any suitable means such as with a conventional adhesive for example, an acrylic adhesive like the cyanoacrylote, Loctite 454. The friction retarding surface layer 25 is secured to the vibration absorption layer in a similar fashion. The support member 21 also supports a sheet entrance guide 28 which has a surface with a low coefficient of friction and has a substantially vertical portion 29 and a substantially horizontal portion 30 which overlies a portion 31 of the friction retard surface layer. The sheet entrance guide 28 which is normally urged upwardly by the vibration absorption layer 26 and the friction retarding surface layer 25 is vertically compliant and movable in the support member 21 by suitable mounting means such as tabs 32 on each side of the support member and cooperative mounting means such as coupling 33 having channels 34 to enable the sheet entrance guide to move vertically on the tabs. There is a void 36 between the vertical portion of the sheet entrance guide and the top friction retarding surface layer 25 and the intermediate vibration absorption layer 26 with the void adjacent the vibration absorption layer being larger than that adjacent the retarding surface layer. These voids enable the sheet entrance guide to be vertically compliant as indicated by the bidirectional arrow illustrated in FIG. 7 and to also be somewhat flexible in a direction normal to the bidirectional arrow and facilitates a mode of operation which overcomes the multi-sheet feed problem noted above by replacing a high spring rate, fixed rigid guide of FIG. 6 with a compliant movable guide having a low spring rate which therefore reduces the magnitude of the normal force when a slug of sheets enters the entrance guide area when the slug of sheets force the compliant movable entrance guide down, the normal force is reduced because the spring rate is reduced. As a result the drive force driving the sheets into the retard nip is lower and is insufficient to drive the slug of sheets through the nip permitting the retard pad to shingle the sheets in the normal way. In this context by the term spring rate we intend to define the slope of a plot of applied force (y axis) versus displacement (x axis) force per unit of displacement as the spring rate with the fixed rigid entrance guide having a much higher spring rate than the compliant movable guide according to the invention. A significant consequence of the above structure is that the spring rate in the entrance guide are A of FIG. 7 is approximately half the magnitude of the spring rate in the retard area B.

Turning once again to FIGS. 2 and 7 the retard assembly is mounted in a frame 36 by means of locating members 38 and is pivotably mounted about pivot pin 40 an axis 42 in mounting clip 44 the end 46 of which clips under frame 36 holding the assembly in the frame. Torsion spring 24 urges the front edge of the retard assembly against the separated feed roll.

The friction retarding surface is made from the ethylene propylene diene terpolymer rubber known as EPDM which provides a relatively stable coefficient of friction for the retarding surface and can be selected from those materials described in Lentz et al U.S. Pat. No. 4,314,006 which is hereby incorporated by reference in its entirety herein. Such materials are commercially available from various suppliers such as Exxon Chemical Co., USA under the trade designation Vistalon 2504-099, E. I. Dupont Company under the trade designation Nordell 1440.

It is preferred to cure the EPDM in a free radical crosslinking system comprising a free radical initiator. Exemplary of such a system is a peroxide curing system. Examples of free radical initiators are dicumyl peroxide, benzyl peroxide, and di-t-butyl peroxide. It is also preferred that the ethylene propylene diene terpolymer rubber (EPDM) be cured in a process in which the free radical crosslinking is carried out in the presence of a co-agent which is a reactive monomer itself and which adds to the polymer radical formed by the free radical initiator. This type of coagent promotes trimolecular crosslinking. Triallyl cyanurate and triallyl isocyanurate are examples of such coagents which promote trimolecular crosslinking, that is which join three, rather than merely two, polymer chains together. When triallyl cyanurate or triallyl isocyanurate is used as the coagent, about 0.5 to 3 parts, and preferably about 2 to 2.5 parts, by weight of the coagent may be used per 100 parts of EPDM. The dicumyl peroxide free radical initiator is present in amounts of about 4 to 12 parts and preferably about 8 parts.

In addition, for every 100 parts by weight of EPDM the composition may contain up to 80 parts, preferably 40 to 75 parts of various fillers and or reinforcing agents such as silica and alumina. A lubricant such as zinc stearate may be present in amounts of from about 0.25 to two parts and preferably one part by weight. A processing aid such as zinc methacryate may be present in an amount of from 0.25 to 5 parts and preferably 1.5 parts by weight. Further 2.5 to 20 parts, preferably 5 to 10 parts, by weight of zinc oxide activator stabilizer are provided in a preferred composition. A colorant such as titanium dioxide is typically present in amounts of from 2 to 20 parts, preferably 5 to 8 parts, by weight and up to 50 parts preferably about 5 to 10 parts of a plasticizer softener such as paraffinic oil such as Sunthene 4240 available from Sun Oil Company may be present. Typically, the EPDM friction retarding surface layer has a tensile strength of at least 900 pounds per square inch, an ultimate elongation of 200 per cent ±50 per cent, a maximum compression set of 9 per cent, a tear strength of at least 95 pounds per square inch, a Shore A Durometer of between 63 and 73 and a specific gravity between 1.19 and 2.25.

The above described EPDM composition provides a stable and controllable coefficient of friction for the friction retarding surface layer and in particular one wherein the coefficient of friction is relatively stable at about 1.2 with nominal variation within plus or minus 0.2. In addition, the EPDM terpolymer is resistant to abrasion and surface cracking as well as being resistant to ozone attack and exposure to ultraviolet light.

The vibration absorption layer is a closed cell polychloroprene foam which provides sufficient dampening to the retarding surface layer to reduce the noise otherwise generated from the stick slip phenomenon when feeding relatively heavy paper and transparencies. The polychloroprene foam supplies a spring rate or constant that allows the retard member to deflect at a steady rate without vibration. Further the polychoroprene foam tends to isolate any vibration in the retard member so that it is not transmitted to the frame. The polychoroprene is an elastomer made by the vulcanization of 2-chlorol-1,3-butadine with metal oxides rather than sulfur. The 2 clorol-1,3-butadiene is prepared by the action of hydrogen chloride on monoviny-acetylene.

The expanded polychloroprene has a uniform closed cell structure and is free from cracks or tears or other surface defects which will be detrimental to its function. The closed cell nature of the foam enables bonding at the surface of the foam to the mount and the surface layer without adhesive penetrating the surface to affect the properties of the foam. The foam may have a skin on all surfaces or each surface may be free from skin. When the skin is used it is of the same compound and vulcanized intricately with the cellular structure. The foam typically has an apparent density between 12 and 22 pounds per cubic foot, a compression force deflection of between 5 and 9 pounds per square inch, a tensile strength of at least 70 pounds per square inch, an ultimate elongation of at least 130 percent, a maximum compression set after 24 hours at 23° C. of 25 percent after 24 hours at 50° C. of 40 percent and Shore 00 Durometer between 40 and 60. Such a polychloroprene foam enables control of the spring force at a steady rate in response to deflection by the force of the feed roll in the separating feeding nip. Typical commercially available materials includes the polychloroprene foam R-425-N available from Rubatex Corp; Bedford, Va. and 4219-N available from American National Rubber Co., Huntington, W. Va.

The retard member may be assembled in any suitable fashion. Typically the vibration absorption layer is glued to the support member with a suitable adhesive such as the Loctite 454 previously mentioned when the support member is a plastic. Similarly the EPDM friction retarding surface layer may be glued to the polychloroprene foam layer with the same adhesive. Particularly satisfactory results in reducing the noise created by the stick slip phenomenon have been achieved with a retard member wherein the vibration absorption layer is from about 4 to about 6 times as thick as the friction retarding surface layer. This provides a retard member having a sufficiently thick foam layer to absorb the vibration and thin enough to control deformation under load.

Typically, the friction retarding surface layer is of the order of 0.75 to 1.0 millimeters thick and the vibration absorption layer is of the order of 3 to 6 millimeters thick. In a preferred embodiment the friction retarding surface layer is 0.85 millimeters thick and the vibration absorption layer is from 4 to 4.8 millimeters thick.

Thus, according to the present invention a novel retard assembly as well as sheet separating and feeding device has been provided which solves the problem associated with multi-feeds or slug feeds in prior art devices. In particular by the substitution of a compliant movable sheet entrance guide for the rigid fixed guide of prior art practices, the spring rate in the entrance guide is substantially reduced enabling the retard member to more perfectly shingle the sheets as they enter the retard nip. This is accomplished by providing a movable guide and enabling it to move vertically by removing resistance to the vertical movement by the generally horizontal portion. This general geometry particularly enables the use of a friction retard feeder wherein only a single roll is used for the separating and feeding functions. According to most prior art practices, generally a separate nudger roll is used to advance the top sheet in a stack toward the friction retard feeding device wherein successive sheets are shingled, separated and fed forwardly. Furthermore, the present apparatus has the advantage of enabling the trail edge of the entrance guide to be as close to the retard nip as possible to provide a low coefficient of friction for paper to hit against before it enters the retard zone thereby minimizing lead edge damage from sheet stubbing. In addition to the low coefficient of friction permits sheets to initially contact the guide at a steeper angle and be deflected forward into the retard nip without stubbing. In summary, the movable guide enables a geometry where the trail edge of the entrance guide is as close to the retard nip as possible without multifeeding occurring and provides a broader operating window between misfeeds and multi-feeds.

The patents referred to herein are hereby specifically totally and completely incorporated herein by reference.

While the present invention has been described with reference to the specific embodiments described herein it will be apparent that many alternatives, modifications and variations may be made by those skilled in the art. For example, while the invention has been illustrated with the friction feed member as a roll it could equally well be a belt. Accordingly it is intended to embrace all such alternatives and modifications as may fall within the spirit and scope of the appended claims.

We claim:

1. A retard assembly for use in a friction retard separator and feeder comprising a support member for supporting a retard member and a sheet entrance guide at the incoming end of the retard assembly having a substantially vertical portion and a substantially horizontal portion overlying the incoming guide entrance portion of the retard member in advance of the retard portion of the retard member, said support member includes mounting means for movably mounting said sheet entrance guide and said sheet entrance guide has cooperative mounting means to vertically, movably mount it in said mounting means in said support member, said sheet guide being vertically compliant and movable in said support member to enable a reduction in the spring rate in the entrance guide portion of the retard member to a level substantially below the level in the retard portion.

2. The retard assembly of claim 1 wherein said retard member comprises a top friction retarding surface layer having a stable coefficient of friction and an intermediate vibration absorption layer between said support member and said surface layer.

3. The retard assembly of claim 2 wherein the substantially horizontal portion of the sheet entrance guide overlies a portion of the friction retarding surface layer of the retard member and there is a void between the substantially vertical portion of the sheet entrance guide and the vertical edges of the intermediate vibration absorption layer and the top friction retarding surface layer.

4. The retard assembly of claim 2 wherein said friction retarding surface layer is of an ethylene propylene diene rubber having a stable coefficient of friction of about 1.2, said vibration absorption layer is a closed cell polychloroprene foam having a density of from about 12 to 22 pounds per cubic foot.

5. The retard assembly of claim 1 wherein said sheet entrance guide has a surface having a low coefficient of friction with paper.

6. The retard assembly of claim 1 wherein the void between the substantially vertical portion of the sheet entrance guide and the edge of the intermediate vibration absorption layer is greater than the void between the vertical portion and the edge of the friction retarding surface layer.

7. The retard assembly of claim 1 wherein said mounting means comprises a mounting tab on each side of said support member and said cooperative mounting means on said guide comprises a coupling on each side of the guide to engage said mounting tabs.

8. The retard assembly of claim 7 wherein said support member and said sheet entrance guide are molded plastic members and said mounting tabs and couplings are integrally molded therein respectively.

9. The retard assembly of claim 8 wherein said couplings have channels which engage said mounting tabs to enable said sheet entrance guide to move vertically relative to said support member.

10. A friction retard sheet separator and feeder comprising a sheet support platform for supporting a stack of sheets, sheet feed means mounted for sheet feeding engagement with the top sheet of a stack of sheets when a stack of sheets is on said sheet support platform and a retard assembly mounted for engagement with said sheet feed means to form a separating nip therebetween for separating any overlapped sheets from reaching the nip, said retard assembly comprising a support member for supporting a retard member and a sheet entrance guide at the incoming end of the retard assembly having a substantially vertical portion and a substantially horizontal portion overlying the incoming guide entrance portion of the retard member in advance of the retard portion of the retard member, said support member includes mounting means for movably mounting said sheet entrance guide and said sheet entrance guide has cooperative mounting means to vertically movably mount it in said mounting means in said support member, said sheet guide being vertically compliant and movable in said support member to enable a reduction in the spring rate in the entrance guide portion of the retard member to a level substantially below the level in the retard portion.

11. The feeder of claim 10 wherein said retard member comprises a top friction retarding surface layer having a stable coefficient of friction and an intermediate vibration absorption layer between said support member and said surface layer.

12. The feeder of claim 11 wherein the substantially horizontal portion of the sheet entrance guide overlies a portion of the friction retarding surface layer of the retard member and there is a void between the substantially vertical portion of the sheet entrance guide and the vertical edges of the intermediate vibration absorption layer and the top friction retarding surface layer.

13. The feeder of claim 11 wherein said friction retarding surface layer is of an ethylene propylene diene rubber having a stable coefficient of friction of about 1.2, said vibration absorption layer is a closed cell polychloroprene foam having a density of from about 12 to 22 pounds per cubic foot.

14. The feeder of claim 10 wherein said sheet entrance guide has a surface having a low coefficient of friction with paper.

15. The feeder of claim 10 wherein the void between the substantially vertical portion of the sheet entrance guide and the edge of the intermediate vibration absorption layer is greater than the void between the vertical portion and the edge of the friction retarding surface layer.

16. The feeder of claim 10 wherein said mounting means comprises a mounting tab on each side of said support member and said cooperative mounting means on said guide comprises a coupling on each side of the guide to engage said mounting tabs.

17. The feeder of claim 16 wherein said support member and said sheet entrance guide are molded plastic members and said mounting tabs and couplings are integrally molded therein respectively.

18. The feeder of claim 17 wherein said couplings have channels which engage said mounting tabs to enable said sheet entrance guide to move vertically relative to said support member.

* * * * *